US006339057B1

(12) United States Patent
Knox et al.

(10) Patent No.: US 6,339,057 B1
(45) Date of Patent: Jan. 15, 2002

(54) HIGH FOAMING DETERGENT COMPOSITION HAVING A NON-IONIC SURFACTANT BASE

(75) Inventors: Steven J. Knox, Chicago; Arshad Malik, Mundelein, both of IL (US)

(73) Assignee: Stepan Company, Northfield, IL (US)

( * ) Notice: Subject to any disclaimer, the term of this patent is extended or adjusted under 35 U.S.C. 154(b) by 0 days.

(21) Appl. No.: 09/171,326

(22) PCT Filed: Apr. 14, 1997

(86) PCT No.: PCT/US97/06211

§ 371 Date: Aug. 25, 1999

§ 102(e) Date: Aug. 25, 1999

(87) PCT Pub. No.: WO97/39094

PCT Pub. Date: Oct. 23, 1997

(51) Int. Cl.[7] ..... C11D 1/835; C11D 1/72; C11D 1/75; C11D 1/90; C11D 3/32

(52) U.S. Cl. ..... 510/421; 510/123; 510/237; 510/259; 510/289; 510/313; 510/329; 510/341; 510/350; 510/356; 510/424; 510/470; 510/490; 510/501; 510/502; 510/503; 510/504

(58) Field of Search ..... 510/123, 237, 510/259, 289, 313, 329, 341, 350, 356, 421, 424, 470, 490, 501, 503, 502, 504

(56) References Cited

U.S. PATENT DOCUMENTS

| | | | | |
|---|---|---|---|---|
| 3,537,993 A | | 11/1970 | Coward et al. | 252/8.75 |
| 4,102,825 A | | 7/1978 | Murata et al. | 252/547 |
| 4,493,773 A | * | 1/1985 | Cook et al. | 252/8.8 |
| 4,595,526 A | | 6/1986 | Lai | 252/545 |
| 4,919,837 A | | 4/1990 | Gluck | 252/106 |
| 4,948,531 A | | 8/1990 | Fuggini et al. | 252/544 |
| 5,474,713 A | | 12/1995 | Faber | 252/544 |
| 5,522,942 A | * | 6/1996 | Graubart et al. | 134/40 |
| 5,728,667 A | | 3/1998 | Richter | 510/235 |

FOREIGN PATENT DOCUMENTS

| | | | |
|---|---|---|---|
| EP | 0 638 637 A2 | | 2/1995 |
| EP | 0 651 048 A2 | | 5/1995 |
| EP | 651048 | * | 5/1995 |
| EP | 0 698 660 A2 | | 2/1996 |
| JP | 3188195 | | 8/1991 |
| WO | 92/06160 | * | 4/1992 |
| WO | WO 96/05807 | | 2/1996 |

* cited by examiner

*Primary Examiner*—Yogendra Gupta
*Assistant Examiner*—Charles Boyer
(74) *Attorney, Agent, or Firm*—McDonnell Boehnen Hulbert & Berghoff

(57) ABSTRACT

Disclosed are aqueous liquid cleaning compositions, the compositions being free of anionic surfactants and comprising: (a) linear alcohol ethoxylate; (b) amine oxide or betaine; and other, optional components, such as a cationic ammonium compound.

7 Claims, No Drawings

HIGH FOAMING DETERGENT COMPOSITION HAVING A NON-IONIC SURFACTANT BASE

This is a National Phase application filed pursuant to 35 U.S.C. §371 of International Application PCT/US97/06211, filed Apr. 14, 1997, which claims priority from U.S. application Ser. No. 08/631,938, filed Apr. 15, 1996.

BACKGROUND OF THE INVENTION

1. Field of the Invention

This invention relates to formulations for manually washing dishes, hand soaps, and for high foaming cleaning compositions.

2. Description of the Related Art

Light-duty liquid detergent formulations for kitchen surfaces are well known. Kitchen surfaces include counter tops, stove tops, dishes and any other hard surface commonly found in kitchen environments. The term "dishes" includes any utensils involved in food preparation or consumption. Kitchen surfaces, particularly dishes, must be washed free of food residues, greases, proteins, starches, gums, dyes, oils and burnt organic residues.

Most of the consumer accepted formulations in use include anionic synthetic surfactants with or without a nonionic surfactant. Many of such formulations contain a sulfonate-type anionic surfactant, for example, an alkylbenzene sulfonate or an alkane sulfonate, in conjunction with a sulfate or alkyl ether sulfate, or a nonionic surfactant, for example, an alcohol ethoxylate, an alkyl phenol ethoxylate, a mono- or diethanolamide or an amine oxide. The sulfonate material generally predominates.

It is the anionic surfactant that provides the typical high foaming (suds) characteristics generally associated with dish washing formulations. Foam (suds) is the cleaning efficacy signal relied on by consumers. Nonionic surfactants generally do not provide good foaming characteristics.

U.S. Pat. No. 2,746,928 discloses that it is not possible to mix anionic surface-active agents with quaternary ammonium germicides. The cationic quaternary ammonium germicide reacts with the anionic surface-active agent resulting in a reduction in germicidal and detergent activity.

Thus, anionic surfactants are incompatible with cationic quaternary antimicrobial surfactants and nonionic surfactants do not normally provide significant foaming capability to liquid formulations. Therefore, dish washing liquids combining good foaming and antimicrobial activities are not available to the consumer.

Solutions to the problems posed by the incompatibility of cationic and anionic surfactants have focused on various non-ionic surfactant systems. While having the potential to overcome the known compatibility problems, such systems are not capable of the cleaning efficacy and foam volume demanded by consumers. Hence, there remains a critical need for cleaning compositions based on non-ionic surfactant systems that provide excellent cleaning with high foam volume.

SUMMARY OF THE INVENTION

In general, anionic surfactant systems such as those found in the current light duty liquids are classified as high foamers. Conversely, nonionic surfactant systems are classified as low foamers.

By careful selection and extensive experimentation, we have identified nonionic and nonionic/amphoteric surfactant mixtures that produce consumer acceptable foam comparable to commercial dish washing liquids that use anionic detergents. The useful nonionic surfactants include ethoxylates that have various chain lengths not exceeding 12 carbon atoms and degrees of ethoxylation that allow the dish washing liquid to be effective on a wide range of food soils while providing excellent flash foam volume and foam stability. This system provides the consumer with effective cleaning on, but not limited to, greasy food soils, fatty food soils, and oily food soils.

The invention provides surfactant compositions based on nonionic surfactant components that function as cleaning compositions. Further included in the invention are disinfectant hand soaps, body washes, disinfectant or antibacterial dishwashing liquids, and conditioning shampoos. Each of these latter cleaning compositions includes at least one cationic ammonium salt. The specific cationic salts are selected depending on the ultimate use or function of the cleaning composition.

Certain formulations of this invention will control the presence and spread of bacteria on hard surfaces in the kitchen environment, especially dishes. In this context, the invention is a microbiological active quaternary ammonium salt ingredient homogeneously incorporated into a nonionic aqueous surfactant system. Unexpectedly, the formulations of the invention have excellent flash foaming and residual foaming capability although no anionic surfactants are included.

The invention also provides personal care compositions including a quaternary ammonium compound which is a conditioning compound.

Thus, the invention provides hand soap compositions comprising a nonionic surfactant base in combination with at least one cationic ammonium compound. The ammonium compound may be an antibacterial compound or a conditioning agent, or both. Certain hand soap formulations will include a conditioning agent and an antimicrobial compound. Similar formulations may be formulated to function as conditioning shampoos.

The unexpected foaming properties of the formulations of the invention are illustrated in the examples. The foaming properties are due to the carefully balanced mix of nonionic surfactants. The formulations tested in these examples contain preferred concentrations of ingredients.

Thus, the invention provides aqueous liquid cleaning compositions, the compositions being free of anionic surfactants and consisting essentially of a nonionic surfactant system and a cationic ammonium compound.

Significantly, the invention also provides high foaming nonionic or nonionic/amphoteric systems that are excellent grease cutters.

The nonionic surfactant system may comprise (1) from about 0.1–50% by weight based on the weight of the composition of a linear alcohol ethoxylate having an average carbon chain length of no more than 12 carbon atoms; and (2) a surfactant member selected from the group consisting of amine oxides and betaines. In these compositions, the total concentration of active components in the composition based on the weight of the composition is at least about 5%. Optional non-ionic surfactants include alkanolamides, alkyl polysaccharides, betaines,and polyhydroxy fatty acid amides. In various embodiments of the invention, these optional components may replace a portion of the alcohol ethoxylate.

The nonionic surfactant systems of the invention may be combined with a variety of cationic ammonium compounds, such as for example, quaternary ammonium compounds or cationic conditioning agents, to produce a cleaning composition that functions as dishwashing cleaner such as a an antimicrobial dishwashing liquid or handsoap or as a conditioning cleaner such as a conditioning shampoo.

DETAILED DESCRIPTION OF THE INVENTION

As used herein, the term disinfecting or disinfectant refers to antimicrobial and/or antibacterial activity. Disinfectant, antimicrobial and antibacterial formulations of the invention are capable of reducing the rate of microbial, i.e., bacterial, reproduction, and/or killing microbial organisms.

The invention encompasses detergent compositions containing various combinations of linear alcohol ethoxylates and nonionic surfactants selected from amine oxides and betaines. Typical compositions also include at least one cationic ammonium compound. In preferred embodiments, the detergent or cleaning compositions comprise a linear alcohol ethoxylate, an amine oxide, an alkyl mono- or dialkanolamide, and a cationic ammonium compound. In such compositions, the balance of the material is water. In particularly preferred embodiments, the weight ratio of linear alcohol ethoxylate to amine oxide is from about 3:1 to 1:3.

A particularly preferred detergent composition according to the invention is the following:

a detergent formulation free from anionic surfactants consisting essentially of:

(a) from about 2–23%, preferably 8–18%, by weight of a linear alcohol ethoxylate having 6–12 carbon atoms and 3–12, preferably 3 to 7 moles of ethoxylation per mole of alcohol;

(b) from about 2–23%, more preferably 4–23%, by weight of an amine oxide selected from the group consisting of ($C_{8-16}$) alkyl amido ($C_{1-4}$) alkyl di($C_{1-4}$) alkyl amine oxides and ($C_{10-16}$) alkyl amine oxides; and optionally (c) from about 1–10%, more preferably 3–7%, by weight of ($C_{10-16}$) alkyl mono- or dialkanolamides, where each alkanol portion independently has from 1–6 carbon atoms; and (d) from about 0.5 to 20% of a cationic ammonium compound.

In such compositions, the weight ratio of component (a) to component (b) is most preferably from about 1:3 to 3:1. Most referred linear alcohol ethoxylates have about 4.5 moles of ethoxylation per mole of alcohol. Most preferred alkanolamides are present at about 4–6% by weight of the composition.

Another particularly preferred composition of the invention is a liquid cleaning composition consisting essentially of, by weight of the composition, from about 4–7% of a $C_{8-10}$ alcohol ethoxylate having an average of about 9 moles of ethylene oxide, from about 12–20% of a $C_{8-10}$ alcohol ethoxylate having an average of about 12 moles of ethylene oxide, from about 7–13% of a fatty acid amidopropylamine oxide having an average of about 10–18 fatty acid carbon atoms, from about 1–4% of a fatty acid diethanolamide having an average of about 10–18 fatty acid carbon atoms, from about 1–4% of a fatty acid monoethanolamide having an average of about 10–18 fatty acid carbon atoms; and an antibacterial effective amount of an antibacterial quaternary ammonium compound. A preferred antibacterial quaternary ammonium compound is an alkyl dimethyl benzyl ammonium chloride. The balance of the composition is water. Such a composition may also contain an emulsifier or thickener such as xanthan gum, as well as fragrances, etc.

Still another particularly preferred formulation according to the invention is an aqueous liquid cleaning composition, the compositions being free of anionic surfactants and consisting essentially of:

(a) from about 13–19% by weight based on the weight of the composition of a linear alcohol ethoxylate having an average carbon chain length of no more than 12 carbon atoms; and;

(b) from about 3–7% by weight of the composition of a mono- or dialkanolamide; and (d) from about 5–10% by weight of the composition of an alkylpolyglycoside.

Yet another composition consists essentially of:

(a) from about 13–19% by weight based on the weight of the composition of a sulfobetaine;

(b) from about 5–20% by weight of the composition of an amine oxide, a betaine, or mixture thereof;

(c) from about 3–7% by weight of the composition of a mono- or dialkanolamide; and (d) from about 3–7% by weight of the composition of an alkylpolyglycoside, the total concentration of surfactants in the composition being from about 30–35% by weight of the composition.

Optional, non-essential ingredients include fragrances, dyes, stabilizers, thickeners, etc.

Nonionic Surfactants

The surfactants suitable for use in the inventive compositions include the following nonionic surfactants.

Alcohol Ethoxylates

In the condensation products of aliphatic alcohols with ethylene oxide, i.e., alcohol ethoxylates, the alkyl chain of the aliphatic alcohol can either be straight or branched and generally contains from about 5 to about 22 carbon atoms. The chain of ethylene oxide can contain from 2 to 30 ethylene oxide moieties per molecule of surfactant. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-7 marketed by the Shell Chemical Company and Kyro EOB marketed by the Procter & Gamble Company.

Amide Surfactant

The amide type of nonionic surface active agents includes the ammonia, monoethanol and diethanolamides of fatty acids having an acyl moiety of from about 7 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by the Fischer-Tropsch process.

The amide surfactants useful herein may be selected from those aliphatic amides of the general formula:

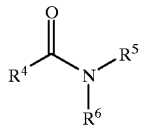

wherein $R^4$ is hydrogen, alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25. A further description and detailed examples of these amide nonionic surfactants are contained in U.S. Pat. No. 4,070,309, issued to Jacobsen on Jan. 24, 1978. That patent is hereby incorporated herein by reference.

Amine Oxide

Amine oxides useful in the present invention include long-chain alkyl amine oxides, ie., those compounds having the formula

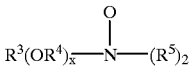

wherein $R^3$ is selected from an alkyl, hydroxyalkyl, acylamidopropyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 3, preferably 0; and each $R^5$ is an alkyl or hydroxyalkyl group containing from 1 to 3, preferably from 1 to 2 carbon atoms, or a polyethylene oxide group containing from 1 to 3, preferably 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dodecylamidopropyl dimethylamine oxide and dimethyl-2-hydroxyoctadecylamine oxide. Preferred are $C_{10}$–$C_{18}$ alkyl dimethylamine oxide, and $C_{10}$–$C_{18}$ acylamido alkyl dimethylamine oxide.

Betaine

The betaines useful in the present invention are those compounds having the formula $R(R^1)_2N^+R^2COO^-$ wherein R is a $C_6$–$C_{18}$ hydrocarbyl group, preferably $C_{10}$–$C_{16}$ alkyl group, each $R^1$ is typically $C_1$–$C_3$, alkyl, preferably methyl, and $R^2$ is a $C_1$–$C_5$ hydrocarbyl group, preferably a $C_1$–$C_5$ alkylene group, more preferably a $C_1$–$C_2$ alkylene group. Examples of suitable betaines include coconut acylamidopropyldimethyl betaine; hexadecyl dimethyl betaine; $C_{12}$–$C_{14}$ acylamidopropylbetaine; C—C acylamidohexyldiethyl betaine; 4-[$C_{14}$–$C_{16}$ acylmethylamidodiethylammonio]-1-carboxybutane; $C_{16}$–$C_{18}$ acylamidodimethylbetaine; $C_{12}$–$C_{16}$ acylamidopentanediethyl-betaine; $C_{12}$–$C_{16}$ acylmethylamidodimethylbetaine. Preferred betaines are $C_{12}$–$C_{18}$ dimethylamoniohexanoate and the $C_{10}$–$C_{18}$ acylamidopropane (or ethane) dimethyl (or diethyl) betaines. Also included are sulfobetaines (sultaines) of formula $R(R_1)_2N+R_2SO_3$—, wherein R is a $C_6$–$C_{18}$ Hydrocarbyl group, preferably a $C_{10}$–$C_{16}$ alkyl group, more preferably a $C_{12}$–$C_{13}$ alkyl group; each $R_1$ is typically $C_1$–$C_3$ alkyl, preferably methyl and $R_2$ is a $C_1$–$C_6$ hydrocarbyl group, preferably a $C_1$–$C_3$ alkylene or, preferably, hydroxyalkylene group. Examples of suitable sultaines are $C_{12}$–$C_{14}$ dihydroxyethylammonio propane sulfonate, and $C_{16}$–$C_{18}$ dimethylammonio hexane sulfonate, with $C_{12}$–$C_{14}$ amido propyl ammonio-2-hydroxypropyl sultaine being preferred.

Polyhydroxy Fatty Acid Amide

The polyhydroxy fatty acid amides useful in the inventive detergent compositions have the formula:

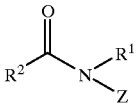

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight-chain $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkylated derivative (preferably ethoxylated or propoxylated) thereof. Z preferably will be derived from a reducing sugar in a reductive amination reaction; more preferably Z is a glycidyl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of of —$CH_2$—$(CHOH)_n$—$CH_2OH$, —$CH(CH_2OH)$—$(CHOH)_{n-1}$ $CH_2OH$, —$CH_2$—$(CHOH)_2(CHOR^1)$—$CH_2OH$, where n is an integer from 3 to 5, inclusive, and $R^1$ is H or a cyclic or aliphatic monosaccharide, and alkoxylated derivatives thereof. Most preferred are glycityls wherein n is 4, particularly —$CH_2$—$(CHOH)_4$—$CH_2OH$.

$R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Alkylpolysaccharides

Alkylpolysaccharides such as those disclosed in U.S. Pat. No. 4,565,647 are nonionic surfactants useful in the present invention. Suitable alkylpolysaccharides include those having a hydrophobic group containing from about 6 to about 30 carbon atoms, preferably from about 10 to about 16 carbon atoms and a polysaccharide, e.g., a polyglucoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4, and/or 6-positions on the preceding saccharide units.

As noted above, the inventive formulatIons include a first nonionic surfactant member selected from the group consisting of linear alcohol ethoxylates, alkyl polysaccharides, betaines, and polyhydroxy fatty acid amides.

In preferred compositions, the first nonionic surfaccant member is preferably a linear alcohol ethoxylate having 6–10 carbon atoms and 3 to 12 moles, more preferably 5–7 moles, of ethoxylation per mole of alcohol. Other preferred alcohol ethoxylates are condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from about 10 to about 20 carbon atoms with from about 2 to about 10 moles of ethylene oxide per mole of alcohol.

Ethoxylated alcohols having no more than 12 carbon atoms in the alkyl position are commercially avaiable and include Neodol™ 1-4; Neodol™ 1-7; Neodol™ 91-8, each of which is marketed by Shell Chemical Company.

The compositions of the invention optionally include a second nonionic surfactant member. In preferred compositions, the second member is an amine oxide in an amount of from about 1–11, more preferably 5–11, % by weight of the composition.

The preferred amine oxides for use as the second surfactant member may be represented by the general formula: $R_1R_2R_3N\rightarrow O$ wherein $R_1$ is a higher alkyl radical having from 8 to 18 carbon atoms, such as lauryl, decyl, cetyl, oleyl, stearyl, hexadecyl or an amide substituted group, such as $RCONH(CH_3)_n$, wherein RCO is a long chain alkanoyl radical and n is a small whole number; $R_2$ and $R_3$ are each lower alkyl radicals such a methyl, ethyl, propyl or a substituted lower alkyl radical such a hydroxyethyl, hydroxyethoxyethyl, hydroxy polyethoxyethyl, etc. Examples of suitable tertiary amine oxides include lauryl dimethyl amide oxide, coconut dimethylamine oxide, dodecyl dimethyl amine oxide,

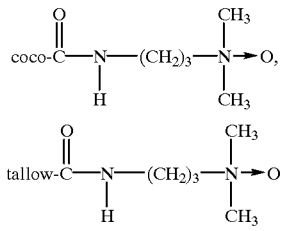

and the like.

The preferred amides are $C_8$–$C_{20}$ alkanol amides, monoethanolamides, diethanolamides, and isopropanolamides. A particularly preferred amide is a mixture of myristic monoethanolamide and lauric monoethanolamide. This preferred amide is sold by Stepan Company, Northfield, Ill. as Ninol LMP.

Cationic Ammonium Compound

The cationic compound is selected according to the desired end use for the formulation—typically, the cationic compound is present in amounts ranging from about 0.5 to 20% by weight of the formulation. The cationic ammonium compound is normally selected from the group consisting of quaternary ammonium salts and amine salts (salts of primary, secondary and tertiary amines).

1. Disinfectant formulations

In the antimicrobial or disinfectant formulations, the purpose of the quaternary ammonium disinfectants is to reduce the rate of reproduction of or kill on contact gram positive and gram negative organisms the organisms encountered in kitchen environments. Useful such disinfectants include BTC 8358 which is N-alkyl (50% $C_{14}$, 40% $C_{12}$, and 10% $C_{16}$) dimethyl benzyl ammonium chloride. Other quarternary ammonium salts may be any of the well-known class of quaternary ammonium germicides characterized by the formula:

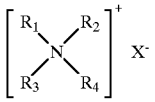

wherein at least one of the radicals, $R_1$, $R_2$, $R_3$ and $R_4$ ("the 'R' groups") is a hydrophobic, aliphatic, aryl aliphatic, or aliphatic aryl radical of from 6 to 26 carbon atoms, the entire cation portion of the molecule has a molecular weight of at least 165, and the remaining R groups are hydrophobic, aliphatic, aryl aliphatic, or aliphatic aryl radical of from 6 to 26 carbon atoms. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, and so forth, in nature. The remaining radicals on the nitrogen atom other than the hydrophobic radicals are substituents of hydrocarbon structure usually containing a total of no more than 12 carbon atoms. The radical X in the above formula is any salt-forming anionic radical.

Suitable quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either, amide or ester linkages such a octyl phenoxy ethoxy ethyl dimethyl benzyl ammonium chloride. N-(laurylcocoaminoformylmethyl)-pyridinium chloride, and so forth. Other very effective types of quaternary ammonium germicides are those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzltrimethyl ammonium chloride, chlorinated dodecylbenzyltrimethyl ammonium chloride, and the like.

Preferred quaternary ammonium germicides of the above general types are the long-chain alkyl dimethylbenzyl quaternary ammonium salts, the alkyl phenoxy alkoxy alkyl dimethyl benzyl quaternary ammonium salts, the N-(acylcocoaminoformylmethyl)pyridinium halides, the long-chain alkyl trimethyl ammonium halides, the long-chain alkyl benzyl dimethyl benzyl ammonium halides, and the long-chain alkyl benzyl diethyl ethanol ammonium halides in which the alkyl radical contains from 8–18 carbon atoms.

The quaternary ammonium salts useful in the invention have the general formula:

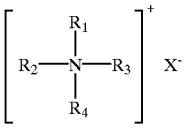

wherein $R_1$ and $R_2$ are straight or branched chain lower alkyl groups having from one to seven carbon atoms; $R_3$ is a straight or branched chain higher alkyl group having from about six to sixteen carbon atoms, or a benzyl group; $R_4$ is a straight or branched chain higher alkyl group having from about six to sixteen carbon atoms; and X is a halogen or a methosulfate or saccharinate ion.

In preferred quaternary ammonium salts, $R_1$ and $R_2$ are methyl groups; $R_3$ is benzyl or straight or branched chain alkyl having from about eight to sixteen carbon atoms; and $R_4$ is straight or branched chain alkyl having from about eight to sixteen carbon atoms provided that not both $R_3$ and $R_4$ have sixteen carbon atoms simultaneously. A preferred halogen is chlorine, or a methosulfate or a saccharinate ion.

Illustrative of suitable quaternary ammonium germicides are: dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{18}$) n-alkyl dimethyl ethylbenzyl ammonium chloride, ($C_{12}$–$C_{18}$) n-alkyl dimethyl benzyl ammonium saccharinate, di($C_1$–$C_7$) alkyl ($C_6$–$C_{26}$) alkyl aryl ammonium salts, di($C_1$–$C_7$)alkyl di($C_6$–$C_{14}$) alkyl ammonium salts, tri($C_1$–$C_7$) alkyl ($C_6$–$C_{26}$) alkyl ammonium salts, ($C_{14}$–$C_{26}$)alkyl di($C_1$–$C_7$)alkyl aryl ammonium salts, and ($C_{14}$–$C_{16}$) alkyl tri ($C_{-C7}$) alkyl aryl ammonium salts. This is not an exhaustive list and other quaternary ammonium salts having germicidal activity will suffice. The quaternary ammonium salt in the present invention need not be a single entity, but may be a blend of two or more quaternary ammonium salts. The amount, in weight-percent, of the quaternary ammonium salt, either as a single entity or blended, is typically from about 0.1%–10.0% and preferably about 1–3%. The preferred quaternary ammonium germicide is a mixture of about 34% by weight $C_{12}$ and 16% by weight $C_{14}$ n-alkyl dimethyl ethylbenzyl ammonium chloride and about 30% by weight $C_{14}$, 15% by weight $C_{16}$, 2.5% by weight $C_{12}$ and 2.5% by weight $C_{18}$ n-alkyl dimethyl benzyl ammonium chloride.

The quaternary ammonium compounds can also function as cationic surfactants to produce antistatic and conditioning effects when deposited on the substrate.

2. Conditioning formulations

The invention also encompasses cleaning compositions capable of imparting a conditioning effect on a substrate such as skin or hair. Such formulations include hand soaps and conditioning shampoos. A variety of cationic surfactants useful as detersive surfactants and as conditioning agents are well known in the art. These materials contain amino or quaternary ammonium hydrophilic moieties which are positively charged when dissolved in the aqueous composition of the present invention. Whether the cationic surfactant functions as a detersive surfactant or a conditioning agent, or both, will depend upon the particular compound as is well understood by those skilled in the art. In general, compounds with longer chain length moieties attached to the cationic nitgogen tehd to exhibit greater conditioning benefits. Cationic surfactants among those useful herein are disclosed in the following documents, all incorporated by reference herein: M. C. Publishing Co., *McCutcheon's, Detergents & Emulsifiers*, (North American edition 1993); Schwartz et al., *Surface Active Agents, Their Chemistry and Technology*, New York; Interscience Publishers, 1949; U.S. Pat. No. 3,155,591, Hilfer, issued Nov. 3, 1964; U.S. Pat. No. 3,929,678, Laughlin et al., issued Dec. 30, 1975; U.S. Pat. No. 3,959,461, Bailey et al., issued May 25, 1976; and U.S. Pat. No. 4,387,090, Bolich, Jr., issued Jun. 7, 1983.

Quaternary ammonium salts include dialkldimethylammonium chlorides and trialkyl methyl ammonium chlorides, wherein the alkyl groups have from about 12 to about 22 carbon atoms and are derived from long-chain fatty acids. These types of cationic surfactants are useful as hair conditioning agents. Examples of quaternary ammonium salts useful herein include di(coconutalkyl) dimethyl ammonium chloride, stearyl dimethyl benzyl ammonium chloride. Stearyl dimethyl benzyl ammonium chloride and cetyl trimethyl ammonium chloride are preferred quaternary ammonium salts useful herein. (Hydrogenated tallow) trimethyl ammonium chloride is a preferred quaternary ammonium salt. Preferred of the conventional cationic conditioning agents are cetyl trimethyl ammonium chloride, lauryl trimethyl ammonium chloride, stearyldimethyl benzyl ammonium chloride, and (partially hydrogenated tallow) trimethylammonium chloride; these materials may also provide anti-static benefits to the present shampoo compositions.

Salts of primary, secondary and tertiary fatty amines are also suitable cationic surfactant materials. The alkyl groups of such amines preferably have from about 12 to about 22 carbon atoms, and may be substituted or unsubstituted. Secondary and tertiary amines are preferred, tertiary amines are particularly preferred. Such amines, useful herein, include stearamido propyl dimethyl amine, diethyl amino ethyl stearamide, dimethyl stearamine, dimethyl soyamine, soyamine, myristyl amine, tridecyl amine ethyl stearylamine, N-tallowpropane diamine, ethoxylated (5 moles E.O.) stearylamine, dihydroxy ethyl stearylamine, and arachidylbehenylamine. Suitable amine salts include the halogen, acetate, phosphate, nitrate, citrate, lactate and alkyl sulfate salts. Such salts include stearylamine hydrochloride, soyamine chloride, stearylamine formate, N-tallowpropane diamine dichloride and stearamidopropyl dimethylamine citrate. Cationic amine surfactants included among those useful in the present invention are disclosed in U.S. Pat. No. 4,275,055, Nachtigal, et al., issued Jun. 23, 1981, incorporated by reference herein.

Cationic conditioning surfactants especially useful in shampoo formulations are quaternary ammonium or amino compounds having at least one N-radical containing one or more nonionic hydrophilic moieties selected from alkoxy, polyoxyalkylene, alkylamido, hydroxyalkyl, and alkylester moieties, and combinations thereof. The surfactant contains at least one hydrophilic moiety within 4, preferably within 3, carbon atoms (inclusive) of the quaternary nitrogen or cationic amino nitrogen. Additionally, carbon atoms that are part of a hydrophilic moiety, e.g., carbon atoms in a hydrophilic polyoxyalkylene (e.g., —$CH_2$—$CH_2$—O—), that are adjacent to other hydrophilic moieties are not counted when determining the number of hydrophilic moieties within 4, or preferably 3, carbon atoms of the cationic nitrogen. In general, the alkyl portion of any hydrophilic moiety is preferably a $C_1$–$C_3$ alkyl. Suitable hydrophile-containing radicals include, for example, ethoxy, propoxy, polyoxyethylene, polyoxypropylene, ethylamido, propylamido, hydroxymethyl, hydroxyethyl, hydroxypropyl, methylester, ethylester, propylester, or mixtures thereof, as nonionic hydrophile moieties. The amino surfactants must be positively charged at the pH of the shampoo compositions. Generally, the pH of the shampoo compositions will be less than about 10, typically from about 3 to about 9.

Other cationic compounds suitable for use in the invention include $NH_4^+$, and mono-, di-, and tri-short chain alkyl ammonium salts.

Adjuvant Materials

Various adjuvant materials may be added to these foaming aqueous detergent compositions such as small amounts of viscosity builders and conditioning agents inclusive of gums and hydroxypropyl methyl cellulose. Such ingredients can be added in an amount that does not adversely effect the foaming and cleaning characteristics of the compositions. Other ingredients may include alkaline or acid buffers to aid in the adjustment and maintenance of the desired pH of the finished product such a borax, various inorganic water-soluble phosphates, sodium hydroxide, citric acid, etc. Other additions include optical brighteners, bleaches, germicides, fungicides, bactericides, colorants, perfumes, etc. in minor amounts which do not interfere with the cleaning, foaming, conditioning, or sanitizing properties of the composition.

Other ingredients include ethylenediamine tetraacetate (EDTA) and polyethylene glycol (PEG) fatty acid esters. EDTA is especically useful in antibacterial cleaning compositions, particularly handsoaps, since it increases the effectiveness of the antibacterial quaternary ammonium compound, in particular against *Pseudomonas Aeruginosa,* a pathogenic gram-negative organism. A representative PEG ester is PEG 600 distearate. This ester provides excellent viscosity enhancement in the inventive surfactant systems by association with other components without causing a loss of clarity or an increase in color.

All documents, e.g., patents and journal articles, cited above or below are hereby incorporated by reference in their entirety.

In the examples, all amounts are stated in percent by weight of active material unless indicated otherwise.

One skilled in the art will recognize that modifications may be made in the present invention without deviating from the spirit or scope of the invention. The invention is illustrated further by the following examples which are not to be construed as limiting the invention or scope of the specific procedures or compositions described herein.

The detergent compositions of the invention are prepared by combining water with the alcohol ethoxylate and amine oxide surfactant members, mixing until uniform and then adding the any optional components, such as, for example, amide or cationic ammonium compound, and again mixing until uniform. Heating may be employed as needed to enhance dissolution of the components.

Various antimicrobial cleaning formulations described herein were analyzed for detergency and foam height. Detergency and foam longevity was evaluated using the miniplate assay described below. Foam height was evaluated according to the Ross Miles Foam Height test as described by J. Ross and J. D. Miles in Oil and Soap, 18; 99 (1941) at 0.032% active concentration using water of 140 ppm hardness at 25° C. Ross-Miles test results are displayed in cm.

Foam Longevity and Detergency Evaluation

The capability of various formulations for cleaning and degreasing was determined by the Mini-Plate Test, as follows:

Preparaton of Soil Materal

1. Melt shortening (Crisco, approx. 100 g) in a beaker at 160° F.
2. Add a small amount (not much needed for deep color) of red dye to melted Crisco and stir until dissolved.
3. Calibrate syringe to deliver 0.36 g of Crisco soil on each plate.
4. Apply 0.36 g of Crisco oil to each of the watchglasses (One large watchglass is equivalent to three mini-plates).
5. When all of the larger watchglasses have been soiled, recalibrate syringe to deliver 0.12 g of Crisco soil to each plate.
6. Apply 0.12 g of Crisco soil to each of the smaller watchglasses.
7. Allow soiled watchglasses to harden at room temperature overnight before using.
8. Soiled watchglasses should always be stored at room temperature [(can be stored indefinitely)].

Procedure for Analyzing Test Formulations

1. A test solution may be made by diluting sufficient product with [tap] water (140 ppm hardness) to a concentration of 0.048% active material. 400 ml of such a solution is employed; heating to about 130–135° F. may be necessary to achieve dissolution of the product.
3. The solution in placed in a Pyrex dish and then agitated with a paintbrush to generate foam, and the temperature of the solution adjusted to 120° F.
4. At this point, large watchglasses (which represent three plates each) are washed, one every 45 seconds, by removing a thin layer of soil at a time from the surface of the plate with the paintbrush, then agitating the paintbrush in the solution to remove the adhering soil (which consequently breaks down the foam). The endpoint of the test is the number of mini-plates washed when further agitation of the solution fails to produce new/additional foam on the solution surface. In certain tests, small watchglasses representing 1/3 the surface area of a large watchglass may be used as the endpoint is neared.

Formulations according to the invention are shown below in the following examples. In all the examples, all amounts are given in percent active by weight of the final formulation unless indicated to the contrary.

| | FORMULATION NO. | | | | | |
|---|---|---|---|---|---|---|
| | 1 | 2 | 3 | 5 | 6 | 7 |
| $C_{6-10}$ alkyl ethoxylate (4EO[1]) (commercially available from Stepan Company as Biosoft FF-600) | 16.50 | 16.50 | 14.00 | 17.60 | 14.85 | 13.20 |
| Cocamido propyl dimethyl amine oxide ($C_{12-14}$ alkyl) (commercially available from Stepan Company as Ammonyx CDO) | 8.50 | 8.50 | 10.50 | 9.0 | 7.65 | 6.80 |
| Lauric ($C_{12-14}$) diethanol amide (commercially available from Stepan Company as Ninol 96-SL) | 2.50 | 1.00 | 2.50 | 2.70 | 2.25 | 2.00 |
| Lauric ($C_{12}$) Myristic ($C_{14}$) mono ethanol amide (commercially available from Stepan Company as Ninol LMP) | 2.50 | 4.00 | 2.50 | 2.70 | 2.25 | 2.00 |
| Benzalkonium ($C_{12-16}$) chloride (commercially available from Stepan Company as BTC-835) | 2.00 | 2.00 | 2.00 | 0.00 | 5.00 | 8.00 |

-continued

| | | | | | | | | |
|---|---|---|---|---|---|---|---|---|
| Mini-plates | | | 40 | 44 | 44 | 42 | 38 | 35 |
| Ross-Miles, cm | | | 14.00 | 11.75 | 14.00 | 12.50 | 14.85 | 14.90 |

| | 8 | 9 | 10 | 11 | 12 | 13 | 14 | 15 |
|---|---|---|---|---|---|---|---|---|
| $C_{6-10}$ alkyl ethoxylate (4EO) | | 8.50 | 11.00 | 9.36 | | 9 | 9 | 16.5 |
| Cocamido propyl dimethyl amine oxide ($C_{12-14}$ alkyl) | 10 | 16.50 | 5.66 | 4.82 | 4.5 | 23 | | |
| APG-600 CS | 5 | | | | | | | 8.5 |
| Lauric ($C_{12-14}$) diethanol amide | 2.5 | 2.50 | 1.67 | 1.41 | 2.0 | | | 2.5 |
| Lauric ($C_{12}$) Myristic ($C_{14}$) mono ethanol amide | 2.5 | 2.50 | 1.67 | 1.41 | 2.0 | | | 2.5 |
| Benzalkonium ($C_{12-16}$) chloride | 2.0 | 2.00 | 12.00 | 15.00 | 2.0 | | | 2.0 |
| Lonzaine (sulfobetaine) | 16.5 | | | | | | | |
| cocoamido-propyl betaine (commercially available from Stepan Company as Amphosol CG) | | | | | | | 23 | |
| $C_{9-12}$ alkyl ethoxylate (8EO) | | | | | 8.5 | | | |
| cetyltrimethyl ammonium chloride (commercially available from Stepan Company as Ammonyx Cetac) | | | | | 1.5 | | | |
| tallow amine-2EO | | | | | 2.5 | | | |
| $NH_4Cl$ (aq.) | | | | | 4.0 | | | |
| Mini-plates | 39 | 46 | 32 | 21 | 26 | 33 | 33 | 33 |
| Ross-Miles, cm | 12.75 | 13.81 | 14.10 | 13.90 | 13.4 | 15.15 | 12.6 | 11 |

| | 16 | 17 | 18 |
|---|---|---|---|
| $C_{11}$ alkyl ethoxylate (4EO) | | | 14.8 |
| $C_{11}$ alkyl ethoxylate (7EO) | 16.50 | | |
| $C_{9-11}$ alkyl ethoxylate (8EO) | | 16.50 | |
| Cocamido propyl dimethyl amine oxide ($C_{12-14}$ alkyl) | 8.50 | 8.50 | 7.65 |
| Lauric ($C_{12-14}$) diethanol amide | 2.50 | 2.50 | 2.29 |
| Lauric ($C_{12}$) Myristic ($C_{14}$) monoethanol amide | 2.50 | 2.50 | 2.20 |
| Benzalkonium ($C_{12-16}$) chloride | 2.00 | 2.00 | 2.00 |

[1]EO refers to the number of moles of ethylene oxide per mole of alcohol.

| CHEMICAL NAME | TRADE NAME | % actives, w/w 19 | 20 |
|---|---|---|---|
| Alcohol Ethoxylate ($C_{8-10}$ 9EO) | Alfonic 810-9 | 5.30 | 6 |
| Alcohol Ethoxylate ($C_{8-10}$ 12EO) | Alfonic 810-12 | 16.79 | 19 |
| Cocoamidapropylamine Oxide | Ammonyx CDO | 10.59 | 12 |

-continued

| CHEMICAL NAME | TRADE NAME | % actives, w/w 19 | 20 |
|---|---|---|---|
| Lauramide Diethanolamide | Ninol 96-SL | 2.65 | 3.0 |
| Lauramide Monoethanolamide | Ninol C12LMP | 2.65 | 3.0 |
| Alkyl Dimethyl Benzyl Ammonium Chloride | BTC 8358 | 2.0 | 2.0 |
| Xanthan Gum | Kelzan T, K5C487 | 0.07 | — |
| Deionized Water | | Q.S. to 100 | Q.S. to 100 |

Broad Spectrum Antimicrobial Hand Soap Formulation

| | Formulation No. (% actives, by weight) | | | | | |
|---|---|---|---|---|---|---|
| | 21 | 22 | 23 | 24 | 25 | 26 |
| Deionized Water | Q.S. to 100 | Q.S. to 100 | Q.S. to 100 | Q.S. to 100 | Q.S. to 100 | Q.S. to 100 |
| Neodol ® 1-7 ($C_8$–$C_{10}$ Alcohol Ethoxylate) | 1.70 | 1.70 | 1.70 | 1.70 | 0–10% | 0–10% |
| Amphosol ® CA Cocamidopropyl Betaine) | 5.00 | 16.67 | 5.00 | 16.67 | 0–20% | 0-66% |
| Ammonyx ® CDO (Cocamidopropyl amine Oxide) | 2.50 | 8.33 | 2.50 | 8.33 | 0–10% | 0–33% |
| Ammonyx ® CO (Cocamine Oxide) | 1.00 | 3.33 | 1.00 | 3.33 | 0–10% | 0–33% |
| Kessco ® PEG 6000 DS (PEG 6000 Distearate) | — | — | 1.00 | 1.00 | 0–5% | 0–5% |
| Ninol ® LMP (Lauramide MEA) | 2.00 | 2.00 | 2.00 | 2.00 | 0–10% | 0–10% |
| BTC ® 835 (Benzalkonium Chloride) | 1.00 | 2.00 | 1.00 | 2.00 | 0–5% | 0–10% |
| Dow Versene ® 100 Tetrasodium EDTA) | 0.20 | 0.51 | 0.20 | 0.51 | 0–0.5% | 0–1.3% |
| $NH_4Cl$ (Optional) | 4.00 | 4.00 | — | — | — | — |
| Viscosity (cps) | | 1920 | | 7290 | | |

Hand Soap and Conditioning Shampoo Formulations

Hand soap and conditioning shampoo formulations according to the invention are prepared essentially by the method described above for dishwashing compositions.

| Ingredient | Formulation A | B | C | D | E |
|---|---|---|---|---|---|
| $C_{9-11}$ alkyl ethoxylate (8EO) | | | 4.40 | | 2.30 |
| $C_{6-10}$ alkyl ethoxylate (4EO) | 5.50 | 4.40 | | 2.30 | |
| cocoamidopropyl dimethyl amine oxide | 2.83 | 2.30 | 2.30 | 4.40 | 4.40 |
| lauric diethanolamide | 0.83 | | | 0.65 | 0.65 |
| lauric myristic monoethanolamide | 0.83 | 1.30 | 1.30 | 0.65 | 0.65 |
| cetyl trimethyl ammonium chloride | | | | | 1.00 |
| benzalkonium chloride | 2.00 | 1.00 | 1.00 | 1.00 | 1.00 |

-continued

| Ingredient | Formulation A | B | C | D | E |
|---|---|---|---|---|---|
| water | q.s. | q.s. | q.s. | q.s. | q.s. |
| Total Actives | 11.99 | 9.00 | 9.00 | 9.00 | 10.00 |

| | Comparative Examples I | II | III | IV |
|---|---|---|---|---|
| $C_{12-13}$ alkyl ethoxylate (6.5EO) | 5 | 14 | | |
| $C_{12-15}$ alkyl ethoxylate (9EO) | 5 | | | |
| $C_{12}$ amine oxide | 5 | | | |
| cocoamidopropyl betaine | 5 | 5 | | 5 |
| Lonzaine JS (sulfobetaine) | 5 | | | 12 |
| Lauric myristic cocodiethanolamide | 5 | 3 | 0.8 | |
| Oleyl dimethyl ammonium chloride | | | | 1.5 |
| Cocodiethanolamide | | | | 3 |
| Cocamido propyl dimethyl amine oxide ($C_{12-14}$ alkyl) | | | | 5 |
| Benzalkonium chloride ($C_{12-16}$) | 1.4 | 1.6 | 9.2 | 1 |
| Mini-plates | 21 | 24 | 42 | 31 |
| Ross-Miles, cm | 7.3 | 7.15 | 10.10 | 10.85 |

From the foregoing, it will be appreciated that although specific embodiments of the invention have been described herein for purposes of illustration, various modifications may be made without deviating from the spirit or scope of the invention.

What is claimed is:

1. An aqueous liquid cleaning composition, the composition being free of anionic surfactants and comprising a nonionic surfactant system consisting essentially of:

(a) from about 0.1–10% by weight based on the weight of the composition of a linear alcohol ethoxylate having an average carbon chain length of no more than about 12 carbon atoms and from about 4–12 moles of ethoxylation per mole of alcohol;

(b) from about 0.05–25% by weight of the composition of a betaine;

(c) from about 0.1–5% by weight of the composition of a mono- or dialkanolamide;

(d) from about 0.05 to 15% by weight of an amine oxide, the combined amount of betaine and amine oxide being from about 0.1 to 30% by weight of the composition;

(e) from about 0.1–5% by weight of the composition of an quaternary ammonium compound, (f) a polyethelyne glycol di fatty ester wherein the polyethylene glycol di fatty acid ester is present in an amount of no more than about 5% by weight of the composition; and the total concentration of surfactants in the composition is no more than about 25% by weight of the composition.

2. A composition according to claim 1, wherein the composition contains from about 0.1 to about 5% by weight of the composition of the alcohol ethoxylate.

3. A composition according to claim 1, wherein the composition contains from about 0.1 to about 2% by weight of the composition of the alcohol ethoxylate.

4. A composition according to claim 1, wherein the composition contains from about 4–18% by weight of the composition of the betaine.

5. A composition according to claim 1, wherein the composition contains from about 3 to about 12% by weight of the composition of the amine oxide.

6. A composition according to claim 1, wherein the composition contains from about 1 to about 2% by weight of the composition of the quaternary ammonium compound.

7. A composition according to claim 1, wherein the composition contains from about 1 to about 5% by weight of the composition of the alkanolamide.

* * * * *